US006052951A

United States Patent [19]

Daoud

[11] Patent Number: 6,052,951

[45] Date of Patent: Apr. 25, 2000

[54] WEATHER HOOD

[75] Inventor: Bassel H. Daoud, Parsippany, N.J.

[73] Assignee: Lucent Technologies, Inc., Murray Hill, N.J.

[21] Appl. No.: 09/146,290

[22] Filed: Sep. 3, 1998

[51] Int. Cl.[7] ..... E04B 1/343

[52] U.S. Cl. ..... 52/64; 52/66; 52/67; 52/71

[58] Field of Search ..... 52/64, 66, 67, 52/71

[56] References Cited

U.S. PATENT DOCUMENTS

| | | | |
|---|---|---|---|
| 2,642,162 | 6/1953 | Tobias | 52/64 |
| 2,728,115 | 12/1955 | Cornelius | 52/67 |
| 3,470,659 | 10/1969 | Koning et al. | 52/64 |
| 4,306,390 | 12/1981 | Brown | 52/64 |
| 4,995,203 | 2/1991 | Brisbin et al. | 52/64 |
| 5,625,982 | 5/1997 | Foote | 52/64 |
| 5,746,237 | 5/1998 | Arinc | 52/66 |

FOREIGN PATENT DOCUMENTS

| | | | |
|---|---|---|---|
| 197803 | 3/1978 | Canada | 52/64 |
| 2610030 | 7/1988 | France | 52/67 |
| 3446769 | 7/1986 | Germany | 52/64 |
| 0658242 | 4/1979 | U.S.S.R. | 52/66 |
| 765375 | 1/1957 | United Kingdom | 52/64 |

*Primary Examiner*—Carl D. Friedman
*Assistant Examiner*—Dennis L. Dorsey
*Attorney, Agent, or Firm*—Synnestvedt & Lechner LLP

[57] ABSTRACT

A weather hood is disclosed having a housing and a plurality of hood segments each formed from a pair of spaced apart pivot arms joined by a shell portion. The hood segments are pivotally mounted on the housing for rotation about an axis passing through the ends of the pivot arms. The hood segments pivot between a retracted position, wherein the hood segments are nested one within another within the housing, and an extended position, wherein the hood segments extend from the housing and are positioned adjacent to each other. Hooks extend from edges of the shell portions, each hook interengaging a hook on an adjacent hood segment or the housing to interlock the hood segments in the extended position and limit their rotation. A spring is connected between the housing to the lowermost hood segment to bias the hood segments into the retracted or extended position.

18 Claims, 4 Drawing Sheets

10
12
14
16
18
20
22
24
28a
28b
28c
30
30a
30b
30c
32
34
36
36a
38
38a
40
42
44
46
46a
46b
A
$d_1$

WEATHER HOOD

FIELD OF THE INVENTION

This invention relates to a weather hood which can serve as a protective weather shield and more particularly to a hood which can be deployed from a compact, retracted position to an extended position as desired.

BACKGROUND OF INVENTION

Electrical junction boxes such as those used for telecommunications, cable television, control systems and power distribution are often mounted outdoors where they are constantly exposed to the elements. Such exposure is normally not a problem for the boxes or their contents as the boxes are designed to be weather proof. However, it is often necessary to perform maintenance on or make modifications to the contents of such boxes. For example, to add new lines to a telephone system or to trouble shoot the system for problems, the junction box must be opened and its contents exposed to the weather. If there is rain or snow during servicing, the internal components of the box can be damaged or rendered inoperable if water is allowed to contact the exposed components. For example, water can cause short circuits in telephone line connectors which disable individual phone lines; it can also cause surge protectors to malfunction and thereby compromise the safety and electrical protection of the entire system.

Currently, technicians servicing junction boxes carry an umbrella to shield themselves and the box when working outdoors during inclement weather. This solution is impractical because the technician typically must hold the umbrella with one hand and work on the box with the other, reducing the efficiency of the technician and increasing fatigue. This solution can be dangerous when the technician must work on a ladder to access the box. Clearly there is a need for an improved means for protecting the contents of an electrical junction box from precipitation when the box is out of doors and being serviced.

Accordingly it is an object of this invention to provide an extendable weather hood useable as a shield to protect water sensitive items.

It is another object of this invention to provide a weather hood which is movable from a compact retracted position into an extended position.

It is yet another object of this invention to provide a weather hood which can be inexpensively fabricated from common materials.

These and other objects of the invention will become apparent from a consideration of the drawings and the detailed description of the preferred embodiment which follows.

SUMMARY OF THE INVENTION

This invention provides an extendable weather hood which can be mounted above an outdoor junction box containing electrical equipment which is adversely affected by water. The weather hood is normally stowed in a compact, retracted position and is manually deployed to an extended position when required to shield the contents of the open box from rain, sleet or snow.

The weather hood according to the invention comprises a support mountable on a permanent structure, such as a building wall. Preferably the support comprises a housing mounted above a junction box, such as a building entry protection unit. A plurality of hood segments are arranged above one another on the support. Each hood segment has a pair of pivot arms oppositely disposed in a spaced apart relationship. Each arm is hingedly connected to the support for rotation about a common axis. A shell portion is connected to and extends between each pair of pivot arms, the shell portion being spaced from the axis of rotation. The shell portion is bounded by two oppositely disposed edges and can have a cylindrical curvature, or a spherical curvature, but it is not limited to these shapes exclusively.

The plurality of hood segments includes a first hood segment adapted to interengage the support to limit its rotation about the axis. Preferably the means for limiting the rotation comprises a hook extending from an edge of the hood segment. The hook engages a mating hook extending from the support which locks the first segment against further rotation.

The plurality of hood segments further includes a second hood segment, which also has means for limiting its rotation. Preferably, the rotation limiting means comprises another hook positioned on an edge of the shell portion. The hook interengages a similar mating hook on an adjacent hood segment to prevent relative rotation of the second hood segment relative to the adjacent hood segment.

Preferably one or more intermediate hood segments are positioned between the first and second hood segments. Means are provided to limit the rotation of each intermediate hood segment, preferably in the form of hooks extending from each shell portion edge. Each hook is designed to engage a corresponding hook on an adjacent hood segment which prevents further rotation of each segment relative to its adjacent segment.

The hood segments are rotatable about the axis between an upward retracted position in which the segments are arranged in a substantially nested overlapping relation and a lowered extended position in which the segments are substantially unnested.

In the extended position each of the hood segments is interengaged with an adjacent hood segment via the hooks. Preferably each hook is formed by an extension of the edge on which it is mounted. The extension can take the form of a simple flange projecting away from the shell section, or the extension can be curved, for example, into a "C" shape. Using the curved hooks the joints between adjacent segments in the extended position can be made relatively water tight by having a first downwardly curving hook on the support which interfaces with an upwardly curving hook on the first hood segment. Following this pattern of a downwardly curving hook on a segment engaging an upwardly curving hook on the next segment below, a series of joints will be created between the hood segments. Water impinging on the shell surface will tend to cascade over the downwardly curving hooks onto the next adjacent hood segment and not leak through the joints.

A biasing member is used to hold the hood segments in either the retracted or the extended positions. Preferably, the biasing member comprises a spring fixed at one end, for example, to the support, with the other end attached to the second hood segment. The spring is arranged astride and offset from the axis of rotation when the hood segments are in either position. This spring arrangement assures that the spring exerts a torque about the axis which biases the hood segments in either position once they are established in a particular position.

It is preferred to make the weather hood from lightweight, durable materials such as plastic or sheet metal such as aluminum.

DETAILED DESCRIPTION OF THE PREFERRED EMBODIMENT

Figures 1, 6:
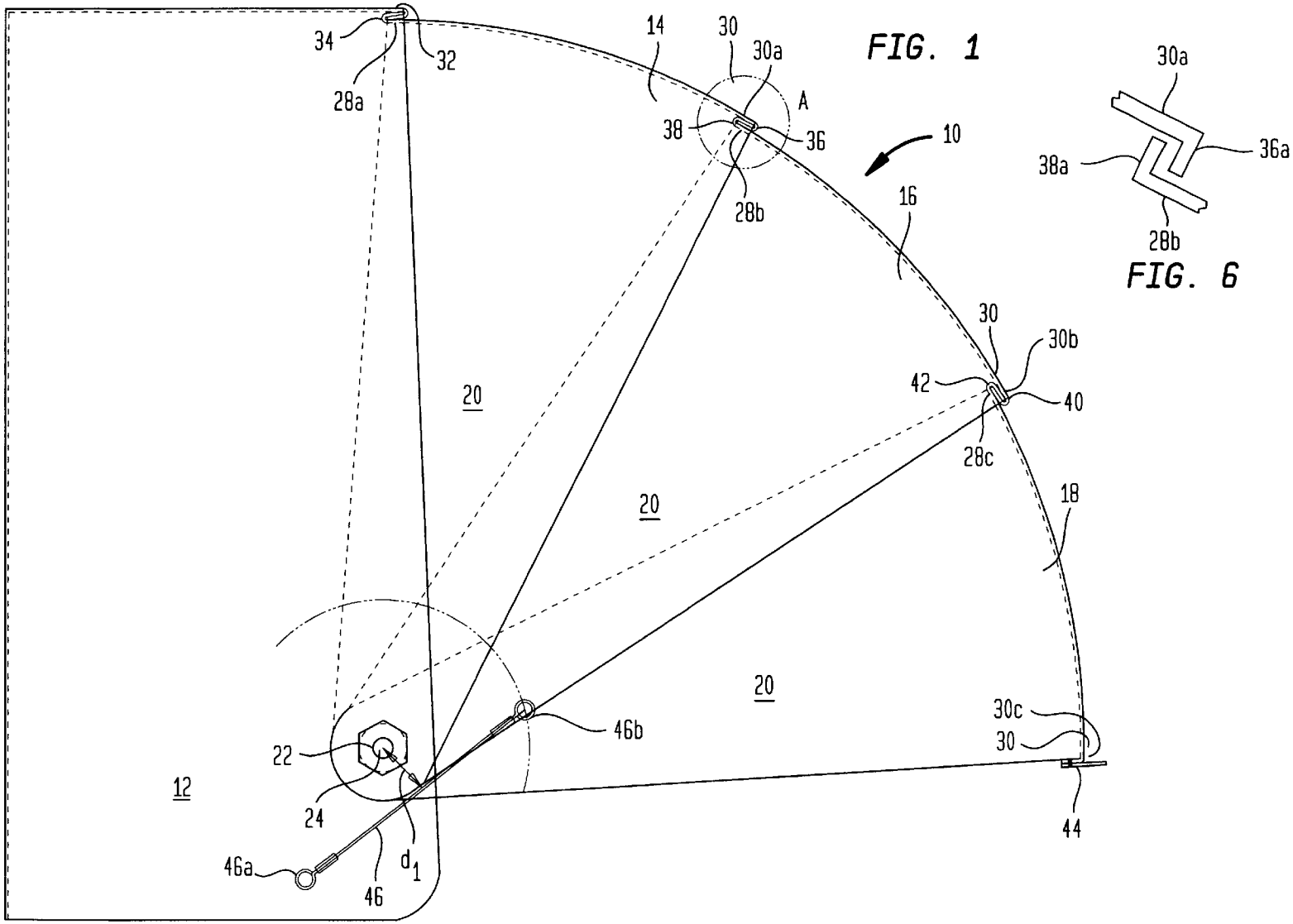
FIG. 1 shows a side view of the weather hood according to the invention in an extended position.
FIG. 6 shows a detailed side view on an enlarged scale of an alternate configuration to the hook shown within the circle "A" in FIG. 1.
Figure 2:
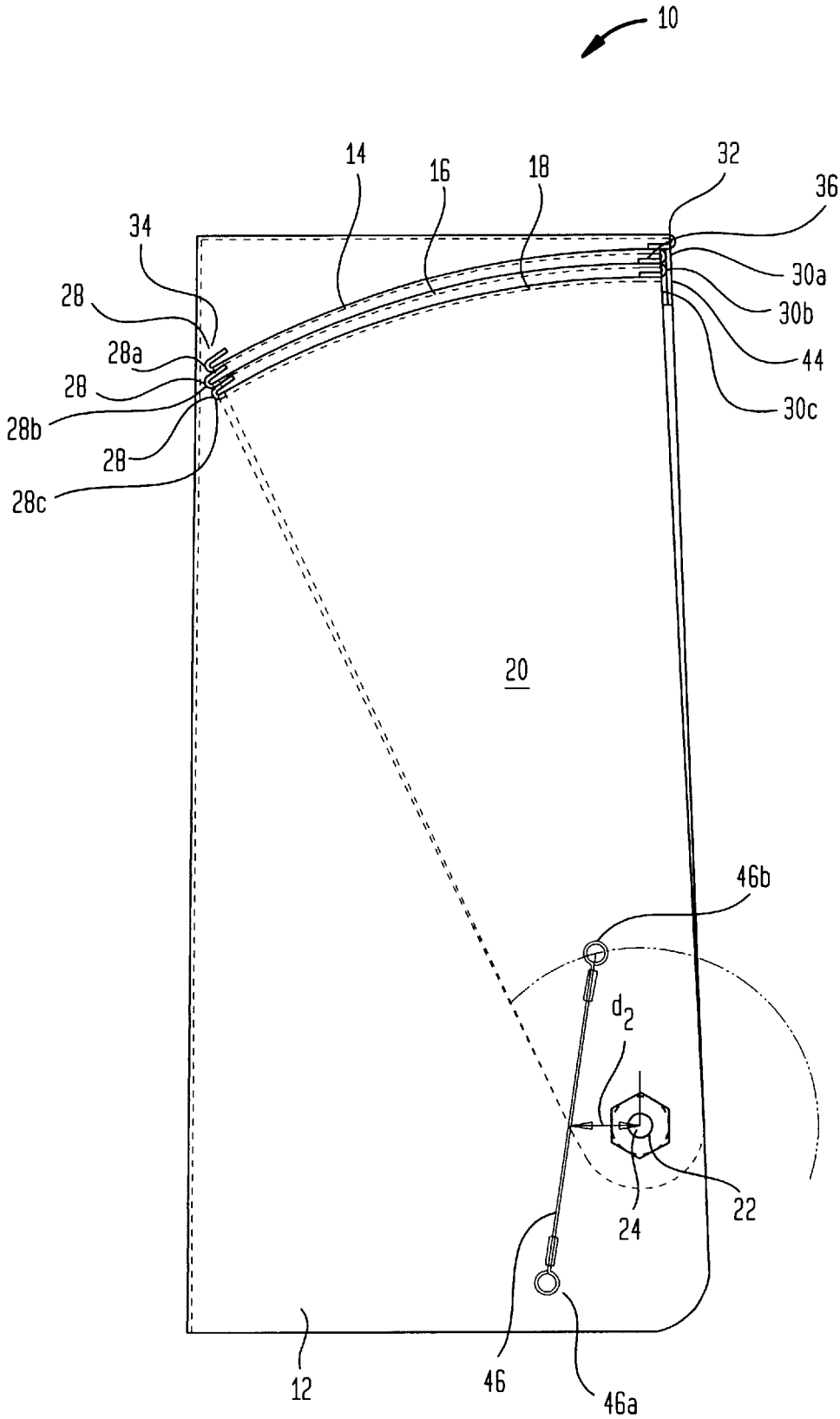
FIG. 2 shows a side view of the weather hood shown in FIG. 1 with the hood in a retracted position.
Figure 3:
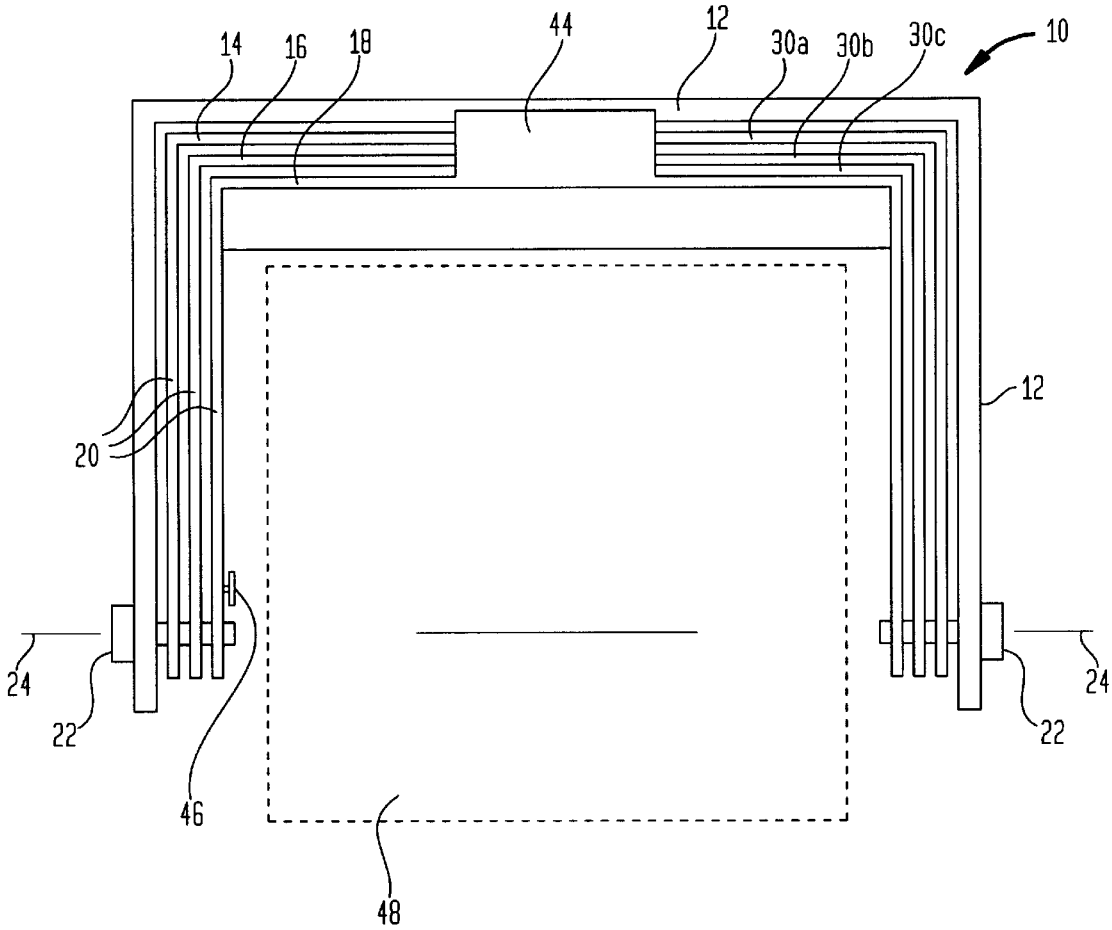
FIG. 3 shows a front view of the weather hood in a retracted position positioned above an electrical junction box which is depicted in phantom line.

FIGS. 1–3 show a weather hood 10 according to the invention having a support in the form of housing 12 which is mountable on a permanent structure, such as a wall. FIG. 1 depicts the hood in its lowered, extended position with a first hood segment 14, an intermediate hood segment 16 and a second hood segment 18 substantially unnested and adjacent each other. In FIG. 2 the hood is shown in its upward, retracted position with the hood segments nested in overlapping relation within one another and within the housing 12. In the illustrated embodiment, the first hood segment 14 is the uppermost of the segments, the second hood segment 18 is lowermost, and the intermediate hood segment 16 is arranged between the first and second hood segments.

Figure 4:
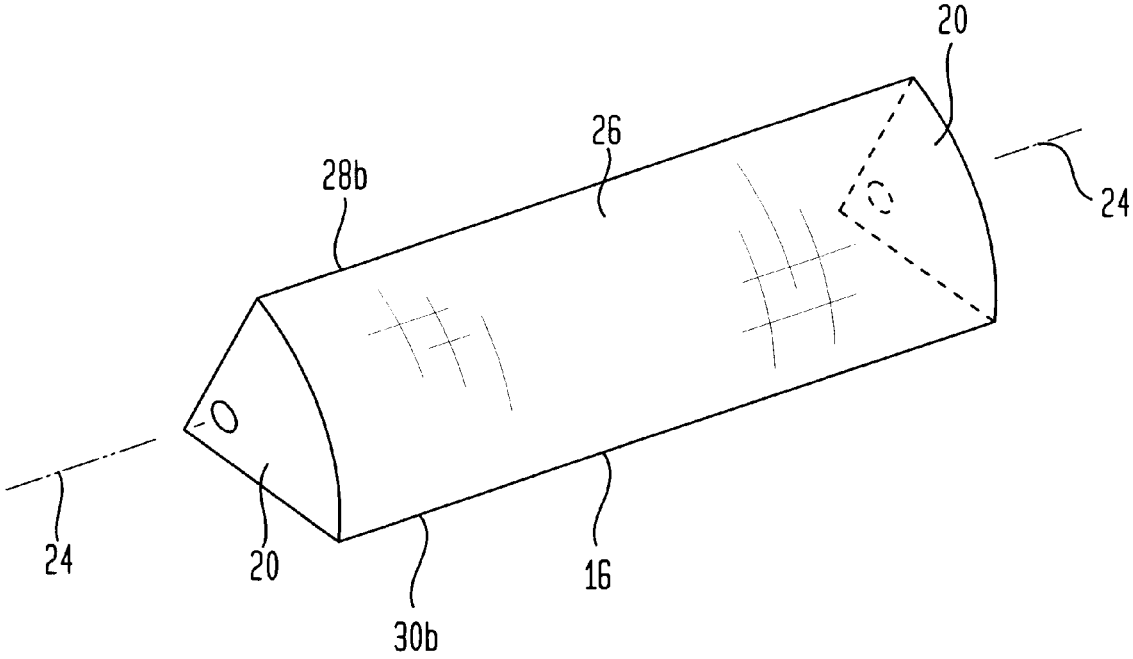
FIG. 4 shows a perspective view of a cylindrically shaped hood segment according to the invention.
Figure 5:
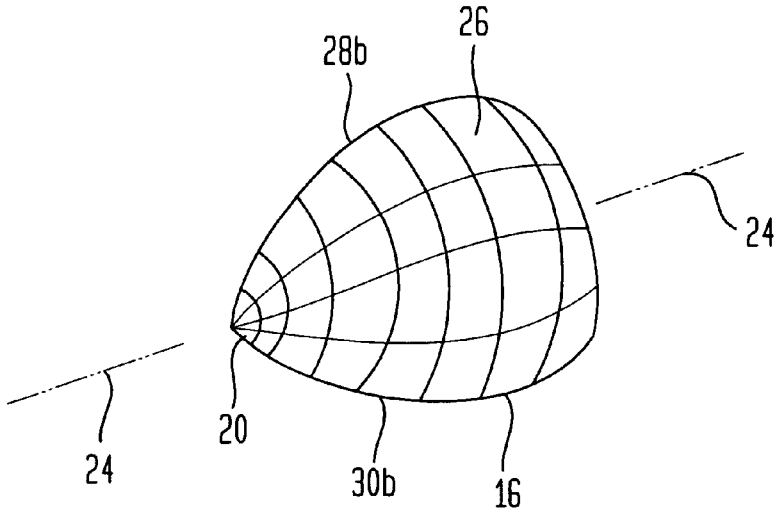
FIG. 5 shows a perspective view of a spherically shaped hood segment according to the invention.

As shown in FIG. 4, by way of intermediate hood segment 16, each hood segment has a pair of pivot arms 20 oppositely disposed in a spaced apart relation. Intermediate hood segment 16 is shown for illustrative purposes only and its structure generally represents all of the hood segments. Each pivot arm is hingedly connected to housing 12 by means such as bolts 22, well known in the art (see FIG. 1). Arms 20 all rotate about a common axis of rotation 24. A shell portion 26 is connected to pivot arms 20 and extends between them, spaced from the common axis 24. Although many shapes are possible, the shell portions preferably have the cylindrical curvature illustrated in FIG. 4 or alternately the spherical curvature of hood segment 16, as shown in FIG. 5.

Each shell portion 26 has a first edge, generally denoted 28, and a second edge, generally denoted 30, oppositely disposed, the edges bounding the shell portion. The edges on each hood segment are distinguished by an appended letter, thus, 28*a* is the first edge on the first hood segment, 28*b* is the first edge on the second segment and so forth. First edge 28 is defined as the inner most edge of each shell portion when the hood is in the retracted position. This is best illustrated in FIG. 2, where all of the first edges 28*a*, 28*b* and 28*c* are shown next to one another and innermost within housing 12 on the left side of the figure.

As best shown in FIGS. 1 and 6, means are provided on the housing and each shell portion to limit rotation of each hood segment. The preferred means is to adapt the edges by shaping them to interengage either the housing 12 or a mating edge, similarly shaped, on an adjacent hood segment. The preferred embodiment can be seen in FIG. 1 where the housing 12 has a hook 32 disposed along an upper edge. First segment 14 has a mating hook 34 arranged along its first edge 28*a* which interengages hook 34 when hood segment 14 is in the extended position shown in FIG. 1. The interengaged hooks prevent hood segment 14 from further rotation about axis 24. Another hook 36 is arranged on the second edge 30*a*. Hook 36 engages a mating hook 38 extending from first edge 28*b* of the intermediate hood segment 16. Interengagement of hooks 36 and 38 limits rotation of the intermediate hood segment relative to first hood segment 14 and housing 12. Lastly, hook 42 on the second hood segment 18 interengages a mating hook 40 on the second edge 30*b* of the intermediate hood segment 16. In this manner the hood segments are locked in the extended position with each hood segment engaging an adjacent hood segment in succession.

Preferably, as seen in FIG. 1, hooks 32, 36 and 40 curve downwardly and mate respectively with hooks 34, 38 and 42, which curve upwardly. The preferred hook configuration shown provides a seal between each hood segment which prevents water from leaking through the hood when extended. The water tends to cascade down over the hooks on the housing and the second edges of the hood segments and flows naturally off of the extended hood. The hooks can extend along the entire width of a segment or can be disposed over a portion thereof.

Any number of shapes are possible for the hooks, with the "C" shaped hooks shown in FIGS. 1 and 2 being preferred. FIG. 6 illustrates hooks 36*a* and 38*a* as an alternate hook embodiment wherein the hooks are formed from a simple outward right angle extension of the respective edges 30*a* and 28*b* on which the hooks are disposed.

As seen in FIGS. 1–3 a lip 44 is preferably disposed along edge 30*c* of the second hood segment 18. The lip 44 serves two functions. When the weather hood is in the retracted position shown in FIGS. 2 and 3 the lip 44 provides a manual means for grasping the hood segments and rotating them into the extended position seen in FIG. 1. When the second hood segment 18 is grasped by lip 44 and rotated about axis 24 hook 42 engages hook 40 and intermediate segment 16 is then rotated. Further rotation causes hook 38 to engage hook 36, which in turn causes the first segment 14 to rotate. Finally when all of the segments are in the extended position hook 34 engages hook 32 and the rotation of the hood segments is limited by the interengagment of each hood segment with an adjacent hood segment and the housing 12.

Lip 44 also functions to engage all of the hood segments and move them from the extended to the retracted position. As best seen in FIG. 3, the lip 44 preferably has sufficient height that it will contact edges 30*a*, 30*b* and 30*c* of each hood segment as the second hood segment 18 is rotated from the extended position of FIG. 1 to the retracted position of FIGS. 2 and 3.

The segments and the housing are preferably fabricated from lightweight, durable materials, plastic or aluminum sheet metal being preferred.

A tensioning means or biasing member 46 is provided, as best illustrated in FIGS. 1 and 2. Preferably, biasing member 46 comprises an elastic member, such as a coil spring, having one end 46*a* fixed to the housing 12 and the other end 46*b*, fixed to the second hood segment 18 and movable therewith. Biasing member 46 is positioned astride axis 24, having ends 46*a* and 46*b* positioned on either side of the axis. Additionally, the biasing member is positioned offset from the axis 24 as seen by the offset distances d1 and d2 illustrated in FIGS. 1 and 2, d1 being on an opposite side of axis 24 from d2. It is seen that the biasing member moves with the second hood segment 18 from a first position offset the common axis 24 when the hood segments are in the upward, retracted position (FIG. 2) to a second position offset the common axis 24 on a side of the common axis 24 opposite from the first position when the hood segments are in the lowered, extended position (FIG. 1).

By positioning biasing member 46 astride axis 24 the biasing member biases the hood segments into either the extended or retracted positions, depending on the position of the biasing member 46 relative to the common axis 24. This can be seen in FIGS. 1 and 2 where the line of action of the biasing forces acts to keep the hood segments extended, as seen in FIG. 1, or retracted, as shown in FIG. 2.

By positioning the biasing member 46 at an offset distance, shown as d1 or d2, the biasing member exerts a torque about the axis 24. This torque keeps the hood segments in either of the two positions once the hood segments are rotated from one position to the other.

The weather hood according to the invention is used by mounting the housing 12 above a junction box 48, shown in phantom line in FIG. 3. The Junction box could be a building entry protection unit for example, which is mounted out of doors. When servicing the box in inclement weather the technician can afford the box protection from the elements by rotating the hood segments into the extended position, thereby providing a relatively dry environment in which to work. The segments can be rotated into the retracted position when not needed, thus forming a compact structure which conveniently stores out of the way, but is immediately ready for use.

What is claimed is:

1. A weather hood, comprising:

a mountable support;

a plurality of hood segments arranged above one another, each of said hood segments having:

a pair of pivot arms oppositely disposed in a spaced apart relationship, each of said arms being hingedly connected to said support for rotation about a common axis;

a shell portion connected to and extending between said pair of pivot arms and spaced from said common axis;

said plurality of hood segments including a first hood segment adapted to interengage said support to limit rotation of said first segment, and a second hood segment;

a biasing member having a fixed first end and a second end attached to and moving with said second segment; and said hood segments being rotatable about said common axis between an upward retracted position wherein said segments are arranged in a substantially nested overlapping relation, and a lowered extended position wherein said segments are substantially unnested, each of said hood segments being interengagable with an adjacent hood segment when said hood segments are rotated into the extended position.

2. A weather hood according to claim 1, wherein:

each said shell portion has a first edge and a second edge disposed opposite to said first edge;

said first edge on said first hood segment being shaped to interengage said support to limit rotation of said first hood segment, and said second edge on said first hood segment being shaped to interengage said first edge of an adjacent hood segment; and said first edge on said second hood segment being shaped to interengage said second edge of an adjacent hood segment, and said second edge on said second hood segment being shaped to engage the second edges of each other hood segment of said plurality of hood segments when said hood segments are in said upward retracted position.

3. A weather hood according to claim 2, wherein each of said first and second edges is shaped into an extension projecting away from each said shell portion of each said hood segment.

4. A weather hood according to claim 3, wherein each said extension comprises a curved hook, said hooks on said first edges being curved in an opposite direction from said hooks on said second edges, said hooks interengaging one another when said hood segments are in said extended position.

5. A weather hood according to claim 4, wherein said plurality of hood segments further comprises an intermediate hood segment positioned in between said first and said second hood segments.

6. A weather hood according to claim 5, wherein said first hood segment is arranged above said intermediate hood segment, said hook on said second edge of said first hood segment curving downwardly toward said intermediate hood segment.

7. A weather hood according to claim 1, wherein said biasing member comprises a spring.

8. A weather hood according to claim 1, wherein said biasing member first end is fixed to said support, and said biasing member is positioned astride said common axis adjacent to one of said pivot arms of said second segment and movable with said second segment from a first position offset from said common axis when said hood segments are in an upward, retracted position, to a second position offset from said common axis on a side of said common axis opposite said first position when said hood segments are in said lowered, extended position, said biasing member exerting a torque about said common axis and biasing said hood segments into said retracted and extended positions.

9. A weather hood according to claim 1, wherein each said shell portion has a cylindrical curvature.

10. A weather hood according to claim 1, wherein each said shell portion has a spherical curvature.

11. A weather hood according to claim 1, wherein said support comprises a housing mountable above a building entry protection unit.

12. An extendable weather hood assembly, comprising:

a mountable housing;

a first hood segment, a second hood segment, and a plurality of intermediate hood segments, each said hood segment comprising a pair of pivot arms arranged in a parallel, spaced apart relationship, each said pivot arm having first and second ends oppositely disposed, said first end being pivotally mounted to said housing for rotation about an axis, each said hood segment further comprising a shell portion extending between said second ends, said shell portion having a first and a second edge;

first means for limiting rotation of said first hood segment relative to said housing;

second means for limiting rotation of said second hood segment relative to an adjacent hood segment;

third means for limiting rotation of each intermediate hood segment relative to an adjacent hood segment;

a tensioning means connected between said housing and said second hood segment for exerting a torque about said axis; and said hood segments being rotatable about said axis between a retracted position wherein said hood segments are nested within one another and within said housing, and an extended position wherein said segments are substantially unnested, said tensioning means exerting said torque for holding said hood in either of said extended or retracted positions.

13. An extendable hood assembly according to claim 12, wherein:

said first means comprises a first hook positioned on said first edge of said first hood segment and shaped to interengage said housing;

said second means comprises a second hook positioned on said second edge of said second hood segment and shaped to interengage an adjacent segment; and said third means comprises third and fourth hooks, one each being positioned respectively on said first and second edges of said intermediate segments, said third and fourth hooks being shaped to interengage an adjacent segment.

14. An extendable hood assembly according to claim 13, wherein each said hook is formed by extending a portion of the edge on which said hook is disposed at a right angle to said shell portion.

15. An extendable hood assembly according to claim 13, wherein each said hook is formed by curving a portion of the edge on which said hook is disposed back upon itself to form a "C" shape.

16. An extendable hood assembly according to claim 12, wherein said shell portions are cylindrically curved.

17. An extendable hood assembly according to claim 12, wherein said shell portions are spherically curved.

18. An extendable hood assembly according to claim 12, wherein said tensioning means comprises a spring positioned astride said axis adjacent to one of said pivot arms on said second hood segment and movable with said second hood segment from a first position offset from said axis when said hood segments are in said retracted position to a second position offset from said axis on a side of said axis opposite said first position when said hood segments are in said extended position.

* * * * *